US005430249A

United States Patent [19]

Phelps, III et al.

[11] Patent Number: 5,430,249

[45] Date of Patent: Jul. 4, 1995

[54] KNOB ASSEMBLY

[75] Inventors: William C. Phelps, III, Plantation; Dwayne A. Daggs, Sunrise, both of Fla.

[73] Assignee: Motorola, Inc., Schaumburg, Ill.

[21] Appl. No.: 71,828

[22] Filed: Jun. 7, 1993

[51] Int. Cl.[6] ..... H01H 3/08; H01H 21/00

[52] U.S. Cl. ..... 174/50; 74/10.2; 200/336; 200/318.1

[58] Field of Search ..... 174/50, 65 G; 74/552, 74/553, 559, 10.2, 10 R; 200/336, 341, 318.1, 318.2, 564, 570, 571, 11 R; 338/163

[56] References Cited

U.S. PATENT DOCUMENTS

| | | | |
|---|---|---|---|
| 3,267,244 | 8/1966 | Schultz . | |
| 3,345,489 | 10/1967 | Kemnitz | 200/318.2 |
| 4,160,890 | 7/1979 | Chard et al. . | |
| 4,439,654 | 3/1984 | Bresin et al. . | |
| 4,843,196 | 6/1989 | Bissig et al. | 200/336 |
| 4,993,280 | 2/1991 | Olkoski et al. . | |
| 5,055,643 | 10/1991 | Pardini et al. | 200/318.2 |
| 5,084,692 | 1/1992 | Finch et al. . | |
| 5,086,200 | 2/1992 | Kline et al. . | |
| 5,180,050 | 1/1993 | Rada et al. | 200/336 X |
| 5,190,503 | 3/1993 | Russ | 74/10.2 X |

*Primary Examiner*—Leo P. Picard
*Assistant Examiner*—Paramita Ghosh
*Attorney, Agent, or Firm*—Juliana Agon; Andrew S. Fuller

[57] ABSTRACT

A self-retaining knob assembly (200) includes a housing (150) and a hub (120). The housing (150) has a cavity(157) for receiving a key (135) and a rotation track (160) about the cavity (157). The hub (120) has an integral key (135) and is rotatably mounted within the cavity (157) and within the rotation track (160). While being mounted, the key (135) is guided into the rotation track (160) by a guide member (266) integrally located on the housing (150). The housing (150) has retaining members (261,262) which cooperate with the key (135) to substantially restrict the removal of the key (135) from within the cavity (157) after the key (135) is mounted.

14 Claims, 3 Drawing Sheets

KNOB ASSEMBLY

TECHNICAL FIELD

This invention relates in general to knob assemblies, and in particular, to knob assemblies used in controlling electronic devices.

BACKGROUND

The use of rotary potentiometers for controlling electronic devices is well known in the art. One common application is the volume control used in car stereos, two-way radios, and the like. The electronic device uses the output of the potentiometer to determine the output level desired by the user. In some implementations, a variable control function, such as volume control, is combined with the on-off switch for the device in a single potentiometer mechanism. A single knob, mechanically connected to the potentiometer, is used as the interface to the user. Typically, the entire knob is pushed to switch the device on or off, while the knob is rotated to vary the volume, or any other variable which is being controlled by the knob. This arrangement, though fairly common, presents some reliability and manufacturability problems which have not been adequately addressed in the art.

In a volume control application, the knob is usually attached to the volume pot which provides mechanical support. After repeated use, mechanical or electrical failure of the volume pot may occur because of an over stressed mechanical connection. When the volume control also includes the device on-off switch, the application of an axial force on the switch by the user can sever solder joints or other electrical connections, thereby shortening the life of the switch assembly. Additionally, the volume pot oftentimes has a rotational limit which defines the maximum and minimum selectable volume level. Excess rotational force applied to the volume pot can cause damage to the volume pot with the possibility of rendering the switch useless.

With some knob assemblies, inadvertent actuation of a device control may be likely. When the knob controls power to the device, inadvertent actuation may result in the draining of the power source. Other knob assemblies can be unintentionally disassembled by pulling on the knob with an insubstantial force. These issues ultimately affect a user's perception of the quality of the device.

A more effective knob assembly, which incorporates solutions to the above-mentioned problems should not increase manufacturing cost or complexity. A cost efficient manufacturing process requires simple operations while utilizing a minimum number of parts, thereby facilitating the assembly operation. Thus, an improved knob assembly for a potentiometer is required which protects the potentiometer from unnecessary stress, which provides enhanced user-friendliness, and which can be manufactured more efficiently.

SUMMARY OF THE INVENTION

Briefly, according to the invention, a self-retaining knob assembly includes a housing and a hub. The housing has a cavity for receiving a key and a rotation track about the cavity. The hub has an integral key and is rotatably mounted within the cavity and within the rotation track. While being mounted, the key is guided into the rotation track by a guide integrally located on the housing. The hub is retained to the housing by retainers cooperating with the key, which substantially restrict the removal of the key from within the cavity after the key is mounted.

DETAILED DESCRIPTION OF THE PREFERRED EMBODIMENT

Figure 1:
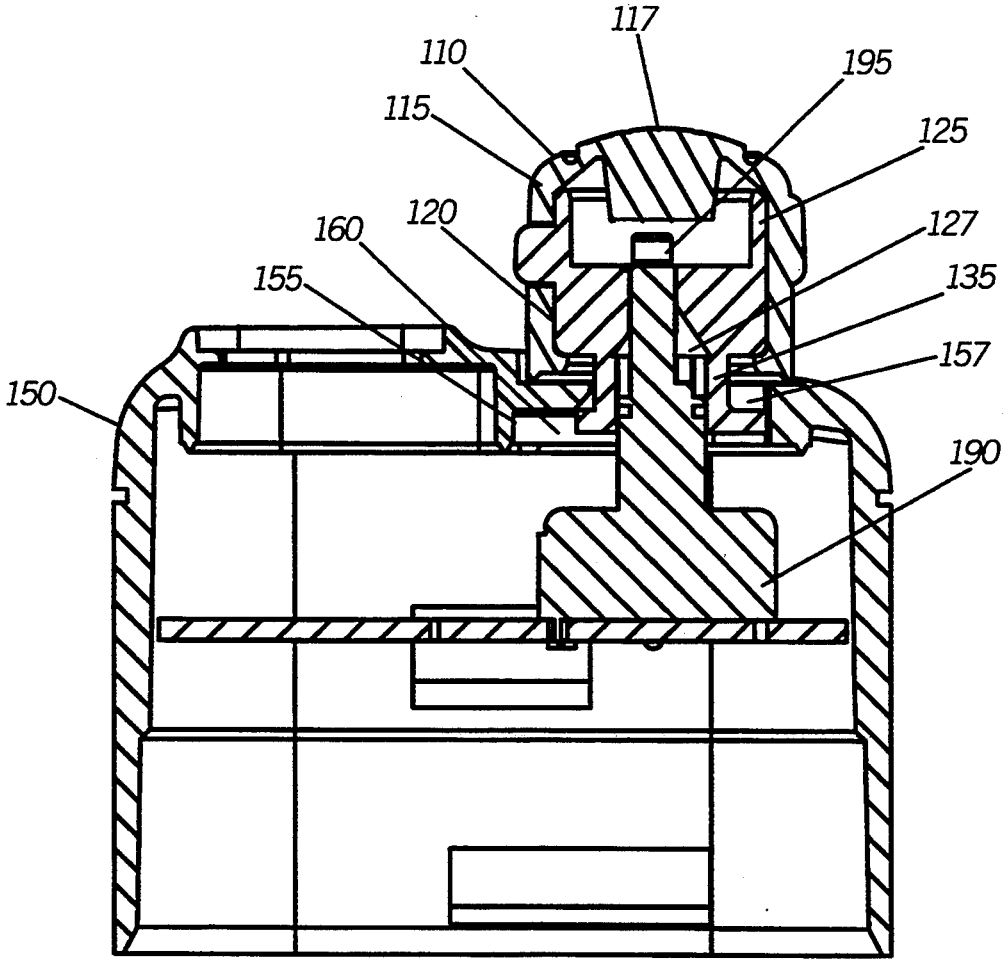
FIG. 1 is a cross-sectional view of a switch assembly in accordance with the present invention.

Referring to FIG. 1, a cross-sectional view of an electronic device, such as a radio 100, is shown which highlights a switch assembly 105 made in accordance with the present invention. The switch assembly 105 comprises a knob 110 mounted to the housing 150 of the electronic device which has a socket area 155 designed to accommodate the knob 110. The knob 110 comprises a hub 120 with a flexible outer cover 115 which has a depressible center top 117. The hub 120 is substantially circular and has a head portion 125, and an integral key portion 135 which extends axially away from the head portion 125. The key portion 135 of the hub 120 is rotatably mounted in a cavity 157 within the socket area 155, and is secured by a rotation track 160 peripherally located about the cavity 157. The socket area 155 facilitates the mounting of the hub 120 to the housing 150, and also controls the degree of rotation of the hub 120 when the hub 120 is mounted to the housing 150. The hub 120 also has an integral central shaft receptacle 127 extending through the hub 120, which accommodates the shaft 195 of a potentiometer 190. The knob 110 and housing 150 are mounted over the potentiometer shaft 195 such that the potentiometer shaft 195 is positioned within the shaft receptacle 127. A central axis extends through the knob 110, including the head portion 125 and key portion 135 of the hub 120, the socket area 155, including the cavity 157 and rotation track 160, and the potentiometer shaft 195, about which the hub 120, including the head portion 125 and key portion 135, is rotatable. Rotation of the knob 110 causes the rotation of the potentiometer shaft 195 within constraints established within the socket area 155 of the housing 150. The potentiometer shaft 195 also actuates a push on-off switch (not shown). Hence, the top of the shaft 195 is located near the top of the hub 120, so that the shaft 195 may be engaged by depressing the center top 117 of the cover 115. The potentiometer 190 is mechanically and electrically coupled to a printed circuit board 195, which houses other electrical circuitry (not shown) and which forms a part of the radio 100.

Figure 2:
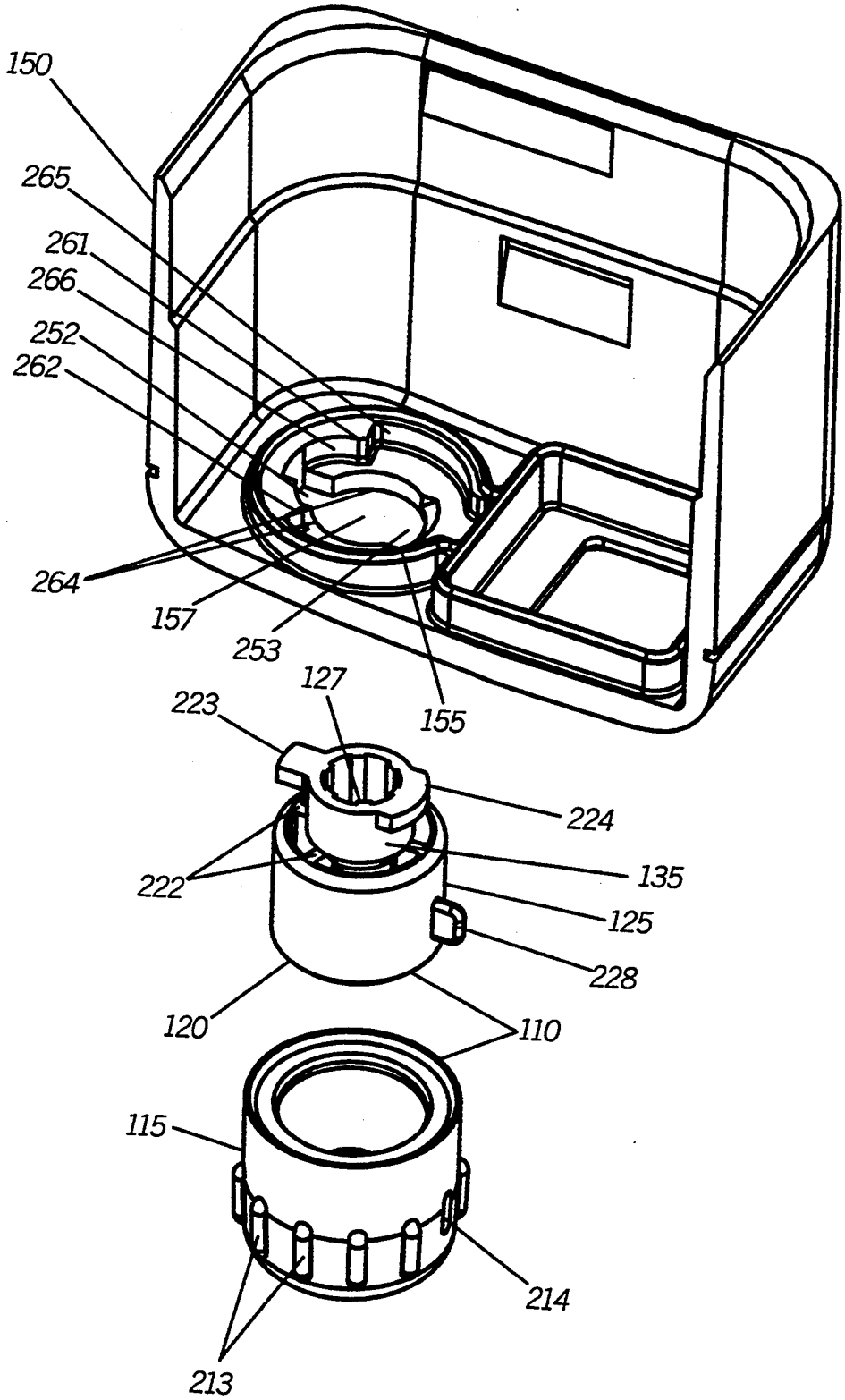
FIG. 2 is an exploded perspective view of a knob assembly, inverted to expose the interior of the housing, in accordance with the present invention.

Referring to FIG. 2, a knob assembly 200 is shown which includes the knob 110 and housing 150. The hub 120, including head portion 125 and key portion 135, is formed from a rigid material, such as plastic, or the like. The dimensions of head portion 125 are larger than those of the key portion 135 or the cavity 157. Particularly, the head portion 125 is larger in diameter than the key portion 135, and larger in diameter than a substantial part of the cavity 157. The head portion 125 has a hollow cylindrical shape with internal trusses 222 to support the key portion 135. This arrangement makes the key portion 135 somewhat resilient, which supports a small degree of deflection of the key portion 135 during assembly. The key portion 135 is also cylindrical and hollow, and has an elongated protrusion 223 and an opposing shorter protrusion 224, both located at the tip of the key portion 135. The elongated protrusion 223 has a radius greater than a substantial part of the cavity 157 with respect to the axis, and the head portion 125 and the protrusions 223,224 combine to substantially restrict the axial movement of the hub 120 with respect to the housing 150. The shaft receptacle 127 extends through the head and key portion 125,135 and is formed to ensure a substantially snug fit when the shaft 195 (see FIG. 1) is inserted. A small projection 228 is located on the outer surface of the head portion 125. This projection 228 is used to aid in mounting the flexible cover 115 to the hub 120. The flexible cover 115 is formed from silicone rubber, or the like, and has ribs 213 on its outer surface to support easy gripping. Additionally, the flexible cover 115 has a slot 214 for receiving the small projection 228 on the hub 120.

The socket area 155 comprises a cavity 157 extending through the housing 150, two key entry areas 252,253 integral to the cavity 157, a rotation track 160 about the cavity 157, rotation stops 261,262 to delimit the rotation track 160, and guide means, for guiding the key portion 135 into the rotation track 160. The cavity 157 is substantially circular, except for the key entry areas 252,253, and has a diameter sufficiently large to permit free rotation of the key portion 135 within the cavity 157. Preferably, the radius of the cavity 157, with respect to the central axis, is less than the radius of at least one protrusion on the key portion 135. Two opposing extensions 252,253 to the cavity 157 are formed in the socket area 155 to create the key entry areas 252,253, which are shaped to match the protrusions 223,224 on the key portion 135 of the hub 120 during assembly. Consequently, the first key entry area 252 comprises an elongated extension to the cavity 157 and has dimensions slightly larger than the elongated protrusion 223 on the key portion 135. Similarly, the second key entry area comprises a shorter extension to the cavity 157 and has dimensions slightly larger than the shorter protrusion 224 on the key portion 135. Each key entry area 252,253 has a radius greater than the radius of the matching protrusion 223,224 with respect to the central axis.

The rotation track 160 is a substantially circular groove extending from the border 264 of the cavity 157, which forms the inner boundary 264 of the track, to a side wall formed in the socket area 155, which forms the outer boundary of the track. The radius of the outer boundary 265 of the rotation track 160, with respect to the central axis, is greater than the radius of both protrusions 223,224 on the key portion 135 which are located within the rotation track 160. Rotation stops 261,262 establish the boundaries of the rotation track 160 and hence the rotational range within the rotation track 160. Additionally, the rotation stops 261,262 cooperate with the key portion 135, in particular the elongated protrusion 223, to substantially restrict the removal of the key portion 135 from within the cavity 157 after the key portion 135 is mounted to the housing 150. The rotation stop 261,262 can be any blocking means that restrict the range of rotation of the knob 110. In the preferred embodiment, the rotation stop 261,262 is a wall which extends from the inner boundary 264 of the rotation track 160 to the outer boundary 265 of the track 160.

The guide means may be any mechanism that helps to urge the key portion 135 into the rotation track 160. In the preferred embodiment, the guide means is a ramp 266 extending from the first key entry area, which corresponds to the elongated protrusion 223, to the first rotation stop 261. Thus, the ramp 266 has a radius at the first key entry area which is greater than the radius of the elongated protrusion 223 with respect to the central axis, and a radius at the first rotation stop 261 which is less than the radius of the elongated protrusion 223 with respect to the axis. The ramp 266 is curved and increases in curvature between the first key entry area and the first rotation stop 261.

To assemble, the flexible cover 115 is placed over the hub 120 such that the slot 214 in the cover 115 is aligned with the small projection 228 on the surface of the head portion 125, thus forming the knob 110. The key portion 135 is then aligned with the cavity 157 of the socket area 155 such that the protrusions 223,224 on the key portion 135 are positioned over the matching key entry areas 252,253 of the cavity 157. The knob 110 is then inserted into the cavity 157 of the socket area 155. Next, the knob 110 is rotated such that the long protrusion travels along the ramp 266, thereby deflecting the key portion 135, and enabling the long protrusion to be seated in the rotation track 160. Referring back to FIG. 1, this assembly is then mounted over the shaft 195 of the potentiometer 190 so that the shaft 195 is positioned within the shaft receptacle 127. The potentiometer shaft 195 has maximum and minimum rotational boundaries (not shown) which define the rotational range of the potentiometer shaft 195. Once the knob assembly 200 (see FIG. 2) is installed over the potentiometer shaft 195, the rotation stops 261,262 of the rotation track 160 prevent rotation of the potentiometer shaft 195 beyond the rotational boundaries of the shaft 195.

Figure 3:
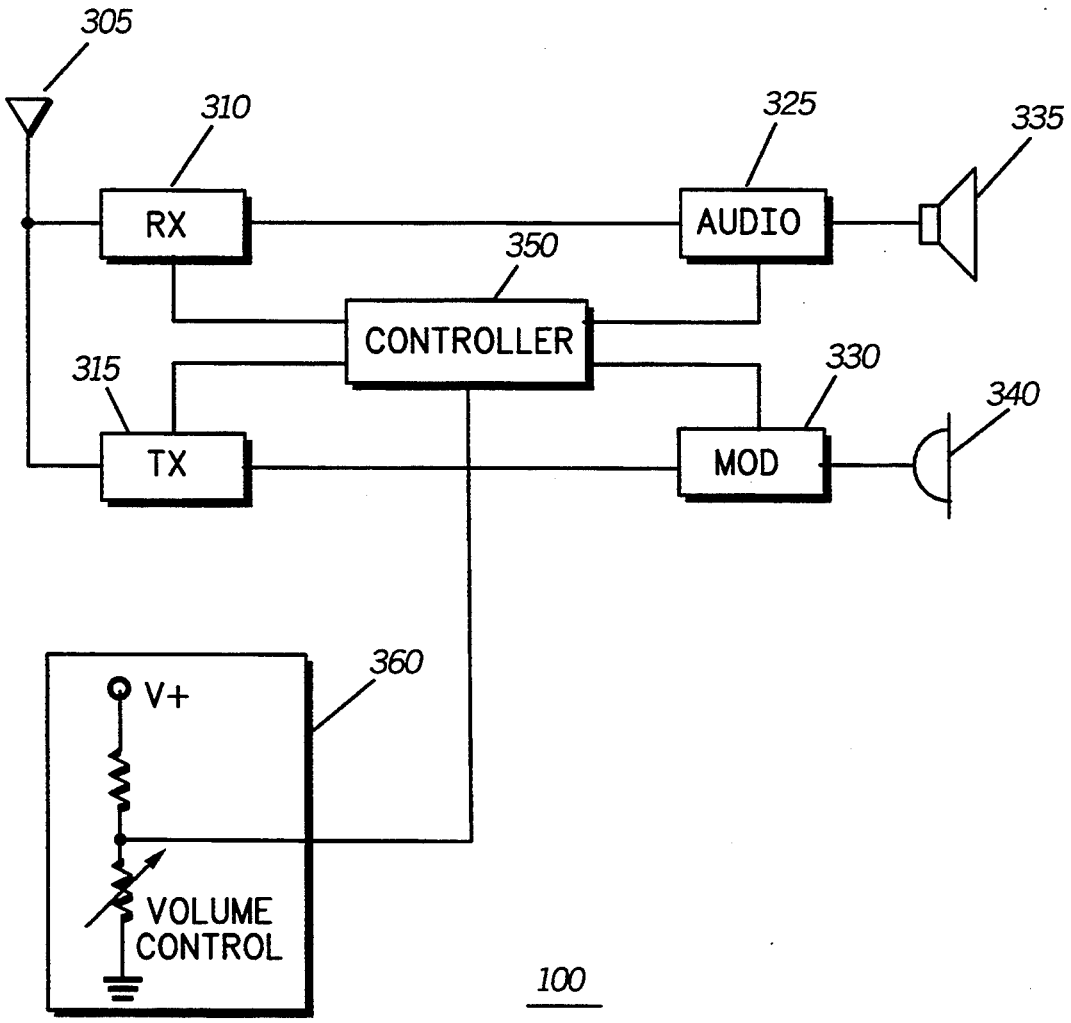
FIG. 3 is a block diagram for a radio which includes a volume control switch assembly in accordance with the present invention.

Referring to FIG. 3, a block diagram is shown for the radio 100 which has a well known configuration. The radio 100 includes a receiver section 310, a transmitter section 315, an audio section 325, a modulator 330, an antenna 305, a speaker 335, a microphone 340, and a controller 350, which constitute means for communicating signals over a RF channel. The receiver 310 receives a communication signal via the antenna 305. The output of the receiver 310 is applied to an audio section 325 which, in addition to other functions, presents messages to a user via a speaker 335. In the transmit mode, the output of a microphone 340 is applied to a well known modulator 330 which presents a modulated communication signal to the transmitter section 315. The transmitter 315 transmits the communication signal via the antenna 305. The controller 350 is programmed to control the overall operation of the radio 100. The controller 350 accepts volume control information from a volume control switch 360 which is made in accordance with the present invention.

Referring again to FIG. 1, an assembly made in accordance with the present invention has several inherent benefits. The axial force transferred to the switch by a user is reduced because the knob 110 is primarily supported by the housing 150 rather than by the mechanical attachment to the potentiometer shaft 195. When the potentiometer shaft 195 actuates a push on-off switch (not shown), the axial force on the shaft 195 can be limited if the shaft 195 is accessible only by depressing the center top 117, and the depressible range of the center top 117 is limited. Thus, there is less stress on mechanical connections to the potentiometer 190. Limitations on the rotational range of the potentiometer shaft 195, which is achieved through the use of the rotation stops 261,262 (see FIG. 2), prevent damage to the potentiometer 190 from excess rotational torque. Manufacturing efficiency is improved since the knob 110 may consist of two parts, the cover 115 and the hub 120, or even a single part if the cover 115 is integrated with the hub 120. Assembly is a simple operation which may be automated. The knob 110 can be designed to minimize unintentionally disassembly, thereby improving the perceived quality of the switch assembly 105.

What is claimed is:

1. A self-retaining knob assembly, comprising:

a housing having a cavity for receiving a key, said housing having a rotation track about said cavity;

a hub having an integral key portion, said key portion rotatably mounted within said cavity and within said rotation track;

guide means, integral to said housing, for guiding said key portion into said rotation track while said key portion is being mounted; and retention means, cooperating with said key portion, for substantially restricting the removal of said key portion from within said cavity after said key portion is mounted, said retention means comprising first and second rotation stops located within said rotation track;

wherein said key portion has a first protrusion, and a second protrusion shorter than said first protrusion, said second protrusion rotatable about said cavity and said rotation track without obstruction from said rotation stops, said first protrusion rotatable within said rotation track and constrained by said rotation stops.

2. A self-retaining knob assembly as defined in claim 1, wherein:

said housing has an key entry area integral to said cavity for accommodating the insertion of said key portion into said cavity; and said guide means comprises a ramp, integrally located on said housing, which extends from said key entry area to said first rotation stop.

3. A self-retaining knob assembly as defined in claim 2, wherein said ramp is curved and increases in curvature between said key entry area and said first rotation stop.

4. A self-retaining knob assembly as defined in claim 1, wherein said hub has a shaft receptacle therein.

5. A self-retaining knob assembly as defined in claim 1, further comprising an outer cover mounted over said hub, said cover having a depressible center top.

6. A self-retaining knob assembly as defined in claim 1, wherein said hub has a head portion and at least one protrusion on said key portion, said head portion and said at least one protrusion substantially restrict the axial movement of said hub with respect to said housing.

7. A switch assembly, comprising:

a housing having a cavity for receiving a key, said cavity having an integral key entry area, said housing having a rotation track about said cavity, said rotation track having first and second rotation stops which delimit said rotation track;

a hub having a shaft receptacle therein, said hub having a head portion and an integral key portion, said key portion rotatably mounted within said cavity, said head portion and said key portion substantially restricting the axial movement of said hub with respect to said housing, wherein said key portion has a first protrusion, and a second protrusion shorter than said first protrusion, said second protrusion is rotatable about said cavity and said rotation track without obstruction from said rotation stops, said first protrusion is rotatable within said rotation track and constrained by said rotation stops;

guide means, integral to said housing, for guiding said key portion into said rotation track while said key portion is being mounted; and a potentiometer with an integral shaft, said shaft receptacle mounted over said shaft.

8. A switch assembly as defined in claim 7, wherein:

said shaft rotatably controls the output of said potentiometer;

said shaft has a maximum and minimum rotation range, said rotation track has a rotation range between the maximum and minimum rotation range of the potentiometer shaft.

9. A switch assembly as defined in claim 7, wherein:

said hub has a depressible top;

said shaft is mechanically connected to a switch such that depression of said shaft actuates said switch; and said hub mounted over said shaft such that depression of said depressible top causes the depression of said shaft.

10. A switch assembly as defined in claim 7, wherein said depressible top comprises a flexible cover mounted over said hub.

11. A switch assembly as defined in claim 7, wherein said hub is formed from a substantially rigid plastic material.

12. A self-retaining knob assembly, comprising:

a housing having a cavity for receiving a key, said cavity having an integral key entry area, said cavity having a border and a rotation track about said border, said rotation track having first and second rotation stops which delimit said rotation track;

a hub having a shaft receptacle therein, said hub having a substantially circular head portion and an integral key portion, said key portion rotatably mounted within said cavity, said key portion having a first protrusion, and a second protrusion shorter than said first protrusion, said second protrusion being rotatable about said cavity and said rotation track without obstruction from said rotation stops, said first protrusion being rotatable within said rotation track and constrained by said rotation stops, said head portion and said first and second protrusions substantially restricting the axial movement of said hub with respect to said housing, said key portion cooperating with said rotations stops to substantially restrict the removal of said key portion from within said cavity after said key portion is mounted;

guide means, integrally located on said housing, for guiding said first protrusion into said rotation track when said hub is rotated; and an outer cover mounted over said hub, said cover having a depressible center top.

13. A radio, comprising:

a radio housing having a cavity for receiving a key, said cavity having an integral key entry area, said housing having a rotation track about said cavity, said rotation track having first and second rotation stops which delimit said rotation track;

a hub having a shaft receptacle therein, said hub having a substantially circular head portion and an integral key portion, said key portion rotatably mounted within said cavity, said head portion and said key portion substantially restricting the axial movement of said hub with respect to said housing, wherein said key portion has a first protrusion, and a second protrusion shorter than said first protrusion, said second protrusion is rotatable about said cavity and said rotation track without obstruction from said rotation stops, said first protrusion is rotatable within said rotation track and constrained by said rotation stops;

guide means, integral to said housing, for guiding said key portion into said rotation track while said key portion is being mounted;

a volume pot having a central shaft, said shaft receptacle mounted over said shaft of said potentiometer, said shaft rotatably controlling the output of said potentiometer, said shaft having a maximum and minimum rotation range, said rotation track having a rotation range between the maximum and minimum rotation range of the potentiometer shaft; and a flexible cover with a depressible center top mounted over said hub such that depression of said depressible top causes the depression of said shaft.

14. A self-retaining knob assembly, comprising:

a housing having a cavity for receiving a key, said housing having a rotation track about said cavity;

a hub having an integral key portion, said key portion rotatably mounted within said cavity and within said rotation track;

a key guide, integral to said housing, to guide said key portion into said rotation track while said key portion is being mounted; and a rotation stop located within said rotation track;

wherein said key portion has a first protrusion, and a second protrusion shorter than said first protrusion, said second protrusion rotatable about said cavity and said rotation track without obstruction from said rotation stop, said first protrusion rotatable within said rotation track and constrained by said rotation stop.

* * * * *